US007358924B2

(12) United States Patent
Boss et al.

(10) Patent No.: US 7,358,924 B2
(45) Date of Patent: Apr. 15, 2008

(54) FEED NETWORK, AND/OR ANTENNA HAVING AT LEAST ONE ANTENNA ELEMENT AND A FEED NETWORK

(75) Inventors: Michael Boss, Riedering (DE); Stefan Hirnböck, Oberaudorf (DE); Maximilian Göttl, Frasdorf (DE); Johann Obermaier, Weiching (DE)

(73) Assignee: Kathrein-Werke KG, Rosenheim (DE)

( * ) Notice: Subject to any disclaimer, the term of this patent is extended or adjusted under 35 U.S.C. 154(b) by 165 days.

(21) Appl. No.: 11/245,475

(22) Filed: Oct. 7, 2005

(65) Prior Publication Data

US 2007/0080884 A1 Apr. 12, 2007

(51) Int. Cl.
*H01Q 21/00* (2006.01)

(52) U.S. Cl. ..... 343/853

(58) Field of Classification Search ..... 343/810, 343/853, 850, 700 MS, 793–795, 797
See application file for complete search history.

(56) References Cited

U.S. PATENT DOCUMENTS

| | | | | |
|---|---|---|---|---|
| 6,333,720 | B1 * | 12/2001 | Gottl et al. | 343/810 |
| 6,621,465 | B2 * | 9/2003 | Teillet et al. | 343/797 |
| 6,697,029 | B2 | 2/2004 | Teillet et al. | |
| 6,943,732 | B2 * | 9/2005 | Gottl et al. | 343/700 MS |
| 7,173,572 | B2 * | 2/2007 | Teillet et al. | 343/810 |
| 2002/0163476 | A1 | 11/2002 | Ericksson | |
| 2004/0108956 | A1 * | 6/2004 | Gottl et al. | 343/700 MS |
| 2004/0263410 | A1 | 12/2004 | Teillet et al. | |
| 2005/0001778 | A1 * | 1/2005 | Le et al. | 343/810 |

FOREIGN PATENT DOCUMENTS

| | | |
|---|---|---|
| DE | 196 27 015 | 1/1998 |
| DE | 197 22 742 | 12/1998 |
| DE | 196 27 015 C2 | 7/2000 |
| DE | 103 59 622 | 7/2005 |
| EP | 0 994 524 | 4/2000 |
| EP | 1 057 224 | 12/2000 |
| WO | WO02/07254 A1 | 1/2002 |
| WO | WO03/088413 A2 | 10/2003 |
| WO | 03/103086 | 12/2003 |
| WO | 2004/001902 | 1/2004 |
| WO | 2004/055938 | 7/2004 |

OTHER PUBLICATIONS

International Search Report issued in related PCT application, 10 pages (Jan. 30, 2007).

* cited by examiner

*Primary Examiner*—Huedung Mancuso
(74) *Attorney, Agent, or Firm*—Nixon & Vanderhye P.C.

(57) ABSTRACT

An antenna feed network is provided with a capacitive coupling device via which a capacitive connection exists to a coupled line. The coupled line section is firmly connected to the downstream appliance or antenna element, or is part of the appliance or antenna element, in the region of the capacitive coupling device. The feed network has a first coupling section and the coupled line has a second coupling section. The two coupling sections are fixed with respect to one another by means of a bracket and/or holding device in a relative position such that relative movement between the two coupling surfaces can take place parallel to the coupling surface.

24 Claims, 4 Drawing Sheets

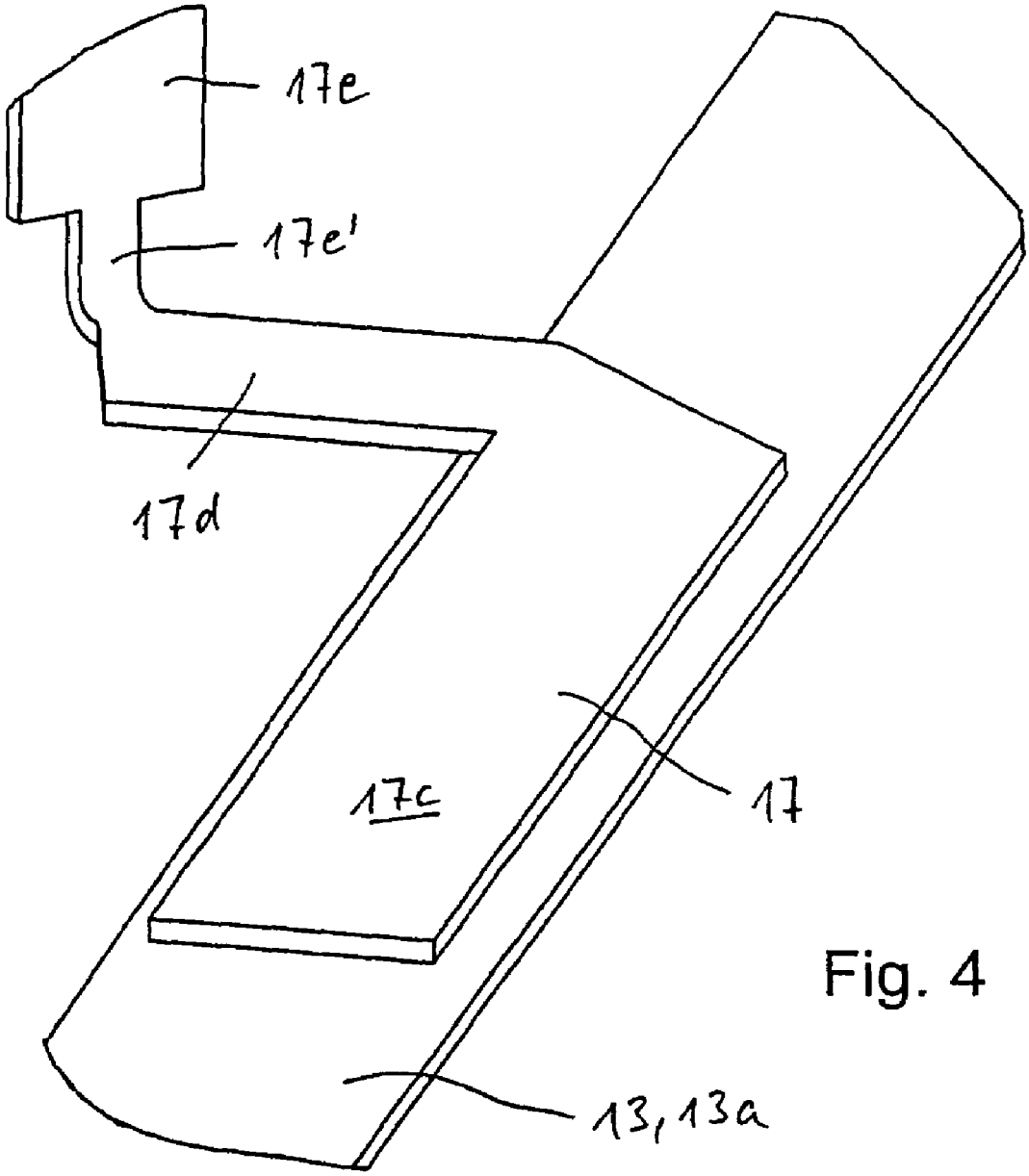
Fig. 4
Fig. 5
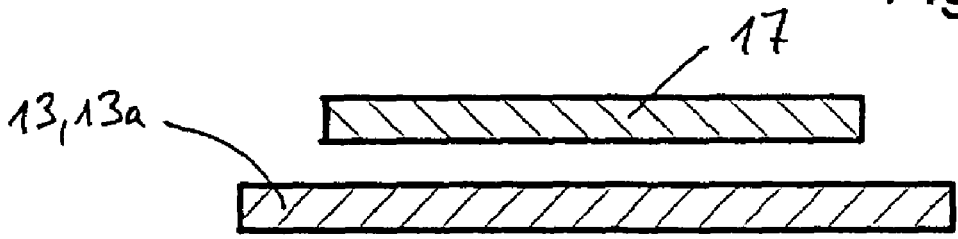

FEED NETWORK, AND/OR ANTENNA HAVING AT LEAST ONE ANTENNA ELEMENT AND A FEED NETWORK

The invention relates to a feed network, and/or an antenna having at least one antenna element and a feed network according to the precharacterizing clause of Claim 1.

Antenna arrays, using dipole antenna elements by way of example, are disclosed as being known from, for example, DE 197 22 742 A, DE 106 27 015 A or, for example, EP 1 057 224 B1. The use of so-called patch antenna elements is likewise also known, which can be installed, like the dipole antenna elements mentioned above, in, for example, the base station of a stationary mobile radio antenna installation.

The antenna arrays with an associated antenna element are fed using a large number of coaxial cables. This coaxial cable technique is expensive owing to the connecting junctions. In this case, it is always necessary to ensure that the electrical contacts are made correctly and that they also withstand electromechanical and thermal stresses.

However, feed systems using stripline technology are also known instead of a coaxial feed system, for example from EP 0 994 524 B1 or from U.S. Pat No. 6,697,029 B2. In the case of feeds such as these, the line which leads to the antenna element is firmly connected to the feed network. In this case, U.S. Pat No. 6,697,029 B2 provides for the stripline feed system, which is composed of a stamped metal sheet, to be arranged above the reflector, using air as the dielectric, and to be firmly connected to a bracket structure, which is then attached to a cruciform dipole by means of screws. In contrast, EP 0 994 524 B1 provides for the feed bracket, which is connected to the feed system that is designed for using stripline technology to be capacitively coupled to a cruciform dipole, rather than electrically conductively.

However, these structures also lead to problems, because relatively large antenna structures also require comparatively tight manufacturing tolerances. Shock effects or vibration can lead to forces being introduced to the connection between the feed line and the antenna element. Bending of the ground plane (reflector) while the distance from the stripline is constant likewise produces movements and tensile or compressive changes in the longitudinal direction of the line.

In addition, thermal strain with a feed technique such as this will lead to movements and mechanical stresses. Deformation could occur and, in the end, fractures as well. These would also correspondingly disadvantageously affect the electrical characteristics, in some circumstances even leading to total failure, so that this feed technique does not in practice represent a real alternative to coaxial conductor feed technology.

One object of the present invention is thus to overcome the disadvantages according to the prior art and to provide an improved feed system, in particular an antenna with at least one antenna element device and an associated feed network for this purpose, which can be constructed at low cost and avoids the disadvantages according to the prior art.

According to the invention, the object is achieved on the basis of the features specified in claim 1. Advantageous refinements of the invention are specified in the dependent claims.

According to the invention, a feed system is now proposed which is largely independent in terms of mechanical and thermal influences, and which allows improved electrical contact conditions, with a simple design overall.

Specifically, according to the invention, a capacitive, flat line coupling is proposed, using stripline technology. The feed network in this case has a coupling surface, with a coupled line being positioned parallel to it and having a second flat coupling surface. This second coupling surface is connected to a downstream feed or supply to an electrical appliance, in particular to an antenna element of an antenna or a mobile radio antenna, to be precise avoiding solder points or other contact points, and forming a continuous coupled line. The feed or supply that has been mentioned for the downstream electrical appliance or, in particular, the antenna element or a downstream antenna element device, is in this case part of this antenna element device. In other words, in particular, a corresponding antenna element device with this coupling device that has been mentioned can be mounted directly on a reflector, producing the desired capacitive inner conductor coupling, while avoiding contact points or solder points. The ground current of the feed network preferably, for the purposes of the invention, passes via the reflector, with the ground current then being able to flow onward via a contact point to the antenna point to the antenna element structure.

The stripline may in this case be designed to be unbalanced, that is to say using a ground plane and one conductor. The stripline may, however, also just as well be designed to be balanced, specifically using one conductor which is arranged between two ground planes.

The coupling surface of the feed network is preferably positioned in such a way as to avoid a solid dielectric, in other words using air as the dielectric. The two coupling surfaces can be positioned in the desired correct relative position with respect to one another only by means of a dielectric holding or bracket device.

In contrast to the implementation explained above, the feed network may, however, also be designed to be in the form of a substrate, for example a continuous substrate, on one side, in which case the substrate may be in the form of a printed circuit. In other words, a ground plane which forms a reflector can be provided on the opposite side of the substrate or of the printed circuit. Further modifications are possible.

In contrast, in the case of the previous coaxial feed networks, the coaxial lines that were used or the feed lines normally had to be laid in loops using stripline technology in order to allow them to absorb movements, so that no mechanical stresses are introduced to the connecting points or solder points. However, a stripline according to the prior art also did not, until now, allow any deformation in the direction of its plane.

According to the invention, the electrical appliance is now preferably coupled to the feed network in the form of an antenna element or in the form of an antenna element device of an antenna, such that no movement and no mechanical forces either can occur in the direction parallel to the ground plane on the feed line, for example, of the dipole antenna element. In the case of the coupling device according to the invention, the line which is coupled to the feed network can be moved relative to the feed network. For example, a movement of 1 mm at a frequency of 960 MHz results in a phase shift of only about 1.2°. A phase error such as this of one antenna element has only negligible effects on the polar diagram. The effect of a phase shift of the impedance of 2.4° occurring on the feed network when the dipole impedance is connected as well is also within the normal range of tolerances, and is negligible.

In contrast, if a feed line were to be pulled away from the dipole foot (ground plane) of the dipole in the case of the prior art, this would result in a major change in the characteristic impedance, and thus a different transformation. Overall, this would influence the matching of the entire antenna.

If it is remembered that the greatest thermal strains always occur in the direction of the greatest strain of a structure, this means in this application that, for example, a thermal change results in a detectable length strain of the stripline, which is normally laid longitudinally, of the feed network. If a corresponding coupling point of an antenna element were now to be firmly connected here, this would lead to considerable thermal stress on the connecting point or solder point. In contrast, according to the invention, quite specific capacitive coupling is provided in a specific refinement and arrangement in order to allow a change in the position and/or length of the feed network, which is in the form of a stripline, caused by vibration, shock or thermal loads, rather than suppressing such changes, to be precise in the sense of a relative movement with respect to a coupling section, which cannot also be moved, of the coupled line which, for example, is integrally or conductively connected to the downstream electrical appliance, in particular to the antenna element or antenna element device of an antenna of a mobile radio base station. The disadvantageous position or length change which was found in the prior art can thus no longer cause any relevant influence according to the invention.

In summary, the solution according to the invention has the following advantages:

- Thermal strain and influences such as shock and/or vibration do not produce any mechanical stress on the components. This leads to better reliability.
- Mechanical movements are compensated for at defined points without this having any influence on, or causing any disadvantageous changes to, the electrical characteristics of the downstream appliance, in particular of the downstream antenna.
- The feed network itself requires no curved sections in order to compensate for an increase in length by this means.
- In fact, the feed network can be designed to be planar for the purposes of the invention. The feed. network can thus also be produced more cost-effectively, with further handling also being significantly simplified.
- Since the feed structure of the downstream appliance, or in particular of the antenna element, is not integrally and/or firmly connected to the antenna element, this therefore means that the relevant parts can be replaced more easily.
- This improves the flexibility in the response to different operating conditions of the connected appliance or antenna element.
- Manufacturing can simplified within the scope of the invention. No specific connection techniques are required, such as soldering, screwing, pressing etc. Furthermore, there are no specific requirements for the surface.

The invention will be explained in more detail in the following text with reference to drawings, in which, in detail:

FIG. 4 shows a three-dimensional enlarged illustration of a detail of a section of the feed network and of the coupled stripline, which is located at a distance above it, in the form of a branch coupler;

FIG. 5 shows a schematic cross-sectional illustration through the detail shown in FIG. 4;

FIG. 1 shows a single-column antenna array, as can be used by way of example in a base station of a mobile radio antenna device.

Figure 1:
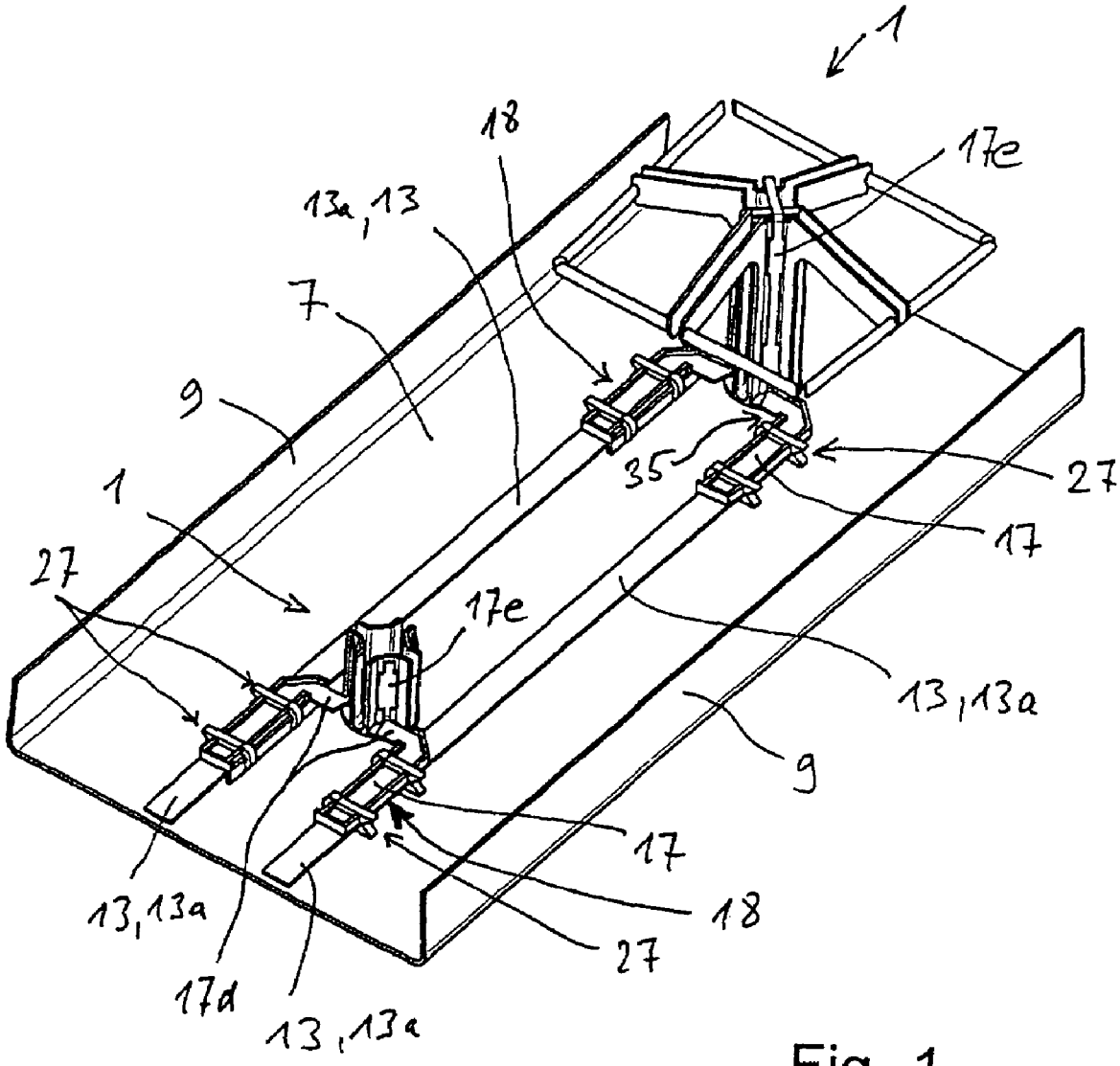
FIG. 1 shows a perspective illustration of a detail of an antenna array having a column and two antenna element devices, which radiate as dual-polarized antenna elements in two mutually perpendicular polarization planes, with a plurality of capacitive coupling devices according to the invention.

The schematic exemplary embodiment illustrated in FIG. 1 has only one comparatively short single-column antenna with two antenna element devices 1, of which only one antenna element device 1 is shown completely, while, in contrast, the antenna element device 1 which is arranged further to the left in FIG. 1 is shown only partially with its mount device 3, which forms the so-called balancing.

The illustrated exemplary embodiment uses a dual-polarized antenna element device 1, which can transmit and/or receive on two mutually perpendicular polarization planes, with the two polarization planes passing through the corner points of the antenna element device 1, which is square when viewed in plan view, that is to say quasi-diagonally with respect to it. This antenna element device is so-called vector dipole, as is known, in principle, from EP 1 057 224 B1. From the electrical point of view, this is a cruciform antenna element, which radiates on the two mutually perpendicular polarization planes that have been mentioned. Reference should therefore be made to this prior publication for further details relating to its design and method of operation.

The antenna element device is located in front of a reflector 7 which, when positioned normally, is arranged such that it runs vertically or runs approximately vertically so that the antenna element devices 1 which have been mentioned are located one above the other in a vertically running column. The reflector 7 can be provided, for example, with boundary or longitudinal webs 9 on its left-hand and right-hand boundary areas, at the outermost edge or offset more toward the center, which can run transversely that is to say they can run at an angle or at right angles to the plane of the reflector 7.

In the illustrated exemplary embodiment, one feed network 13 is used for each polarization and comprises a stripline 13*a*, which is also referred to, for short, as a feed stripline 13*a*.

This stripline 13*a* is arranged in front of the electrically conductive reflector 7, without any electrically conductive contact with it. The stripline 13*a* could be arranged directly on the surface of the reflector 7 only if the reflector 7 were provided on its side to which the antenna element device 1 is fitted and which is composed of electrically non-conductive material, or is provided with an electrically non-conductive surface (when the conductive surface is formed, for example, on the rear face or lower face of the reflector). In this case, the feed network can preferably be formed on a printed circuit, in which case the ground plane which forms the reflector can then be formed on the non-conductive substrate on the opposite face to a feed network.

In the illustrated exemplary embodiment, the two striplines 13*a* run symmetrically with respect to a vertical central plane of symmetry, parallel and at a distance from one another, although this is not shown in FIG. 1, this vertical central plane of symmetry runs at right angles to the reflector plane in the center of the reflector 5, that is to say parallel to the longitudinal webs 9. In this case, FIG. 1 shows that capacitive couplers 118 are now provided, which, for example, may be formed, with respect to the feed network, in the manner of branches as branch couplers 118' or on the end of a supply line, that is to say at the end of a stripline 13 as end couplers 118".

The rest of the design will be described in more detail with reference to FIGS. 2 to 5. As can be seen, a coupled stripline 17 is arranged above part of the length of the feed striplines 13*a*, thus forming a capacitive coupling area 18. Both the coupled stripline 17 and the feed stripline 13*a* each have a coupling surface 13*b* and 17*b*, which in the illustrated exemplary embodiment are planar (flat) and are arranged a short distance one above the other. In the illustrated exemplary embodiment, the width of the coupled stripline 17 (FIG. 3) is slightly narrower than the width of the feed stripline 13*a*. The distance between the two coupling surfaces 13*b* and 17*b* corresponds approximately to the thickness of the stripline 13*a* and/or of the coupled stripline 17*b*. However, this distance may also be of a different order of magnitude, in which case it is preferable to keep the distance as short as possible in order to achieve strong coupling, that is to say, if possible, to be designed to be even shorter than the thickness of the stripline corresponding to the exemplary embodiment.

Figure 2:
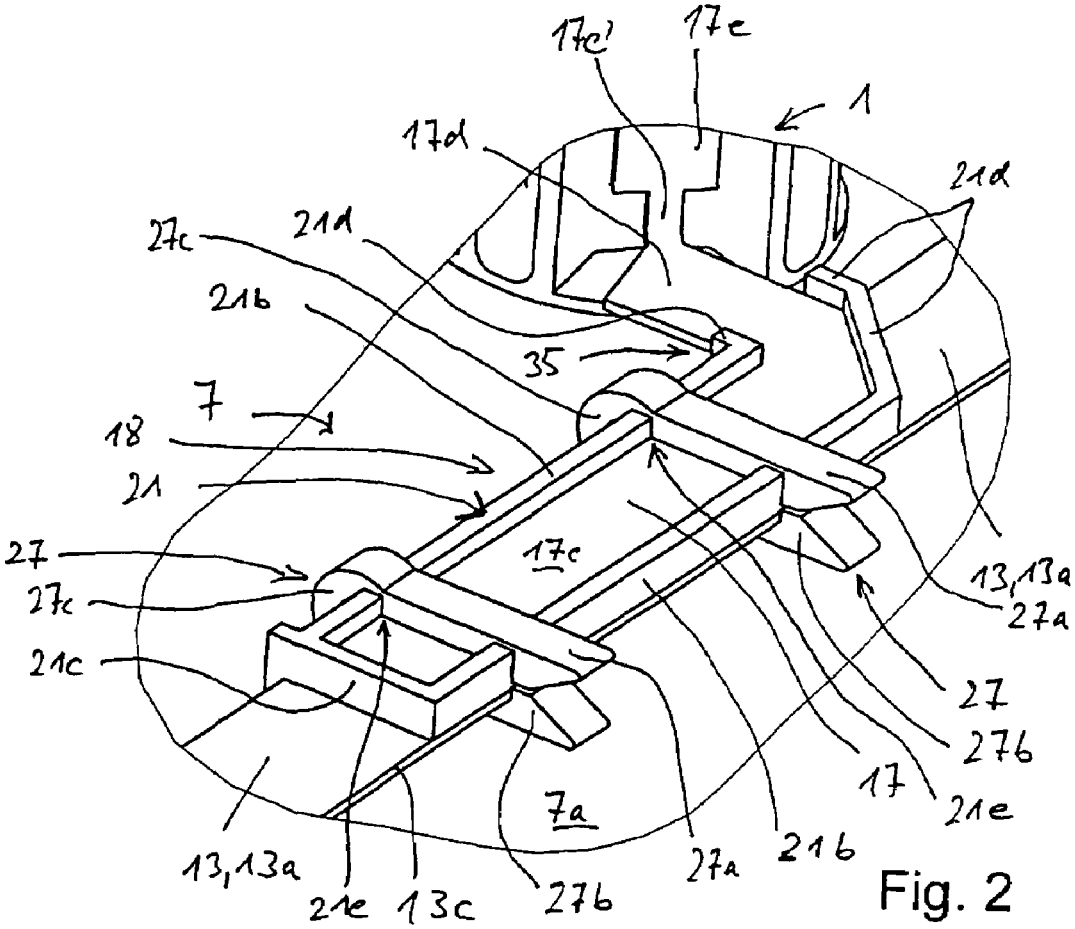
FIG. 2 shows an enlarged detailed illustration of the coupling device according to the invention.
Figure 3:
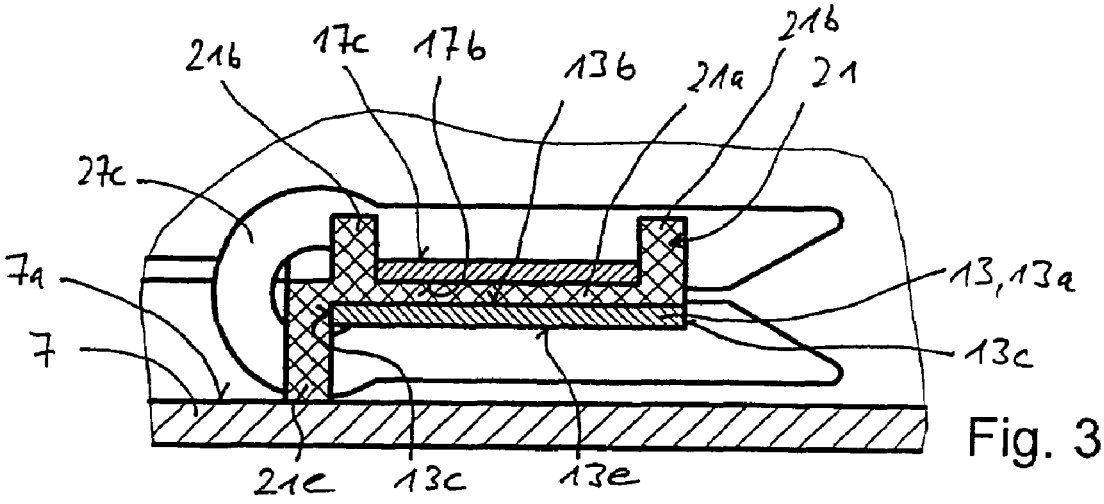
FIG. 3 shows a cross-sectional illustration through the feed network with the coupling line.

As can also be seen from FIGS. 2 and 3, the coupled stripline 17 is held in position in a dielectric receptacle or holder 21 composed of dielectric material which has a base 21*a*, two sides webs 21*b* running in the longitudinal direction, at the free end of the coupling surface 17*b*, a transverse web 21*c* and subsequent web sections 21*d* at the opposite end, which project beyond the coupling surface 17*b* in height.

On at least one longitudinal face, the associated side web 21*b* or the base 21*a* projects beyond the adjacent longitudinal face 13*c* of the feed stripline 13*a* and is provided with a support, supporting foot or supporting strip 21*e* running to the surface 7*a* of the reflector 7, via which the receptacle or holder 21 is supported by the end lower face 21*f* of the support 21*e* on the upper face 7*a* of the reflector 7.

Two bracket or holding devices 27 are also used in the illustrated exemplary embodiment, whose upper limb 27*a* engages under the upper face 17*c* of the coupled feed stripline 13*a*, and whose lower limb 27*b* engages under the lower face 13*e* of the feed stripline 13*a*, with the inner faces, which point towards one another, of the upper and of the lower limb 27*a*, 27*b* preferably resting flat over their entire area on the upper face of the coupling surface 17*b* or the lower face 13*e* of the feed stripline 13*a*, respectively. The two limbs 27*a*, 27*b* are held and fixed in a prestressed manner via a clamping section 27*c* which is in the form of a part of a circle or is rather curved in the cross-sectional illustration.

In order that the limbs can rest thereon over their full area, the side webs 21*b* of the receptacle or holder 21 which have been mentioned each have interruptions 21*e* through which the upper limbs 27*a* of the clamping or holding device 27 project.

The detailed sectional illustration shown in FIG. 3 shows that, in the illustrated exemplary embodiment, the dielectric intermediate layer, that is to say the so-called base 21*a* of the electrical holding device, which is used as a spacer for positioning of the coupled stripline 17 with respect to the supply line for the feed network 13, may have a width which projects beyond the associated conductor in both directions. In other words, the width could be greater than the width of the coupled stripline 17 and greater than the width of the feed networks, like the supply line 13 itself. This makes it possible to achieve an increase in the withstand voltage, specifically by lengthening the creepage path. A layer of dirt or a water droplet therefore has to make a circuitous route in order to bridge the two conductors. In this case, the dielectric isolator could be formed from a plate which has a corresponding projection and thus projects considerably beyond the electrically conductive structures (coupled stripline 17 and feed network 13) on both side edges. It would also be possible to use a printed circuit, for example a fictional printed circuit. On the other hand, the dielectric isolator could also be in a very thin form, as a coating, for example composed of solder resist on a synthetic resin base.

Opposite the free end of the coupled stripline 17 this merges into a connecting section 17*d*, which projects at the side at 90° in the illustrated exemplary embodiment. An appliance or antenna element line 17*e* is connected to the end of this connecting section 17*d* and is passed upward over more than 50%, in particular more than 70% or 80%, of the overall height of the antenna element device 1, and ends at the upper end in a feed section 17*f* which, in the illustrated exemplary embodiment, runs parallel to the reflector plane.

As can be seen from the described design, the entire coupled stripline 17 including its coupling surface 17*b*, the connecting section 17*d* which projects at right angles from it, the supporting section 17*e* which is adjacent to this, and the feed section 17*f* which runs upward comprises or is produced from an integral metal or an integral metal alloy, in particular a metal plate, for example by cutting and/or stamping and subsequent bending, folding and/or edging. The entire coupled stripline 17 therefore has no interruption over its entire profile and is not formed from two separate electrically conductive workpieces connected to one another by welding, soldering or in any other way. Consequently, this results in uniquely reproducible electrical conditions. Only at the end of the end section 17*f* is the stripline that is formed in this way soldered to the feed point of the antenna element structure that is provided there or formed integrally with the antenna element structure. The advantages according to the invention can also just as well be achieved by the coupled stripline 17 as explained above being produced, for example, rather than from a single metal strip or the like, but originally from a plurality of sections, that is to say at least two sections. At least in this case, the components, of which there would then be a plurality, would have to be firmly and conductively connected to one another, so that the coupled stripline 17 can once again be referred to as being continuous, particularly by means of a connection formed by techniques such as bonding, soldering or welding.

Once again in the form of an enlarged detailed illustration, FIG. 4 shows a coupler 118, while FIG. 5 shows a schematic cross-sectional illustration through this coupler 118 in the corresponding capacitive coupling area 18. As can once again be seen, there is no electrically conductive contact, that is to say no conductive contact, between the feed network 13 and the coupled stripline 17 of the coupler 118. The coupled stripline 17 can be arranged and held using any structure for the coupled stripline 17, while avoiding any electrical/conductive contact. The solution described with reference to FIGS. 1 to 3 is only one possible implementation. In the same way, by way of example, side holders composed of dielectric material can be used, which are in the form of a E, so that, by way of example, the stripline network can be kept opposite the reflector, and the coupled stripline 17 can be kept above the supply line for the feed network 13. Holders such as these can be plugged on to the line sections from the left and/or from the right, that is to say from the side edges. It is likewise also possible to use pins or the like in order to keep the individual line or coupling sections at a distance from one another. If required, holes or elongated holes can be incorporated in the individual parts in order to allow relative movement in the longitudinal direction, that is to say in particular in the relative direction between the coupled stripline 17 and the supply line 13 for the feed network. Appropriate modified holding devices can be designed such that they interact by means of a separate spring device or spring force, have integrated spring prestressing, and/or produce such integrated spring prestressing which, for example, presses against the coupling structure from above, and keeps the two line separations (that is to say the coupled stripline 17 and the corresponding supply line 13 for the feed network) in position with respect to one another or on one another, without any play.

Figure 6:
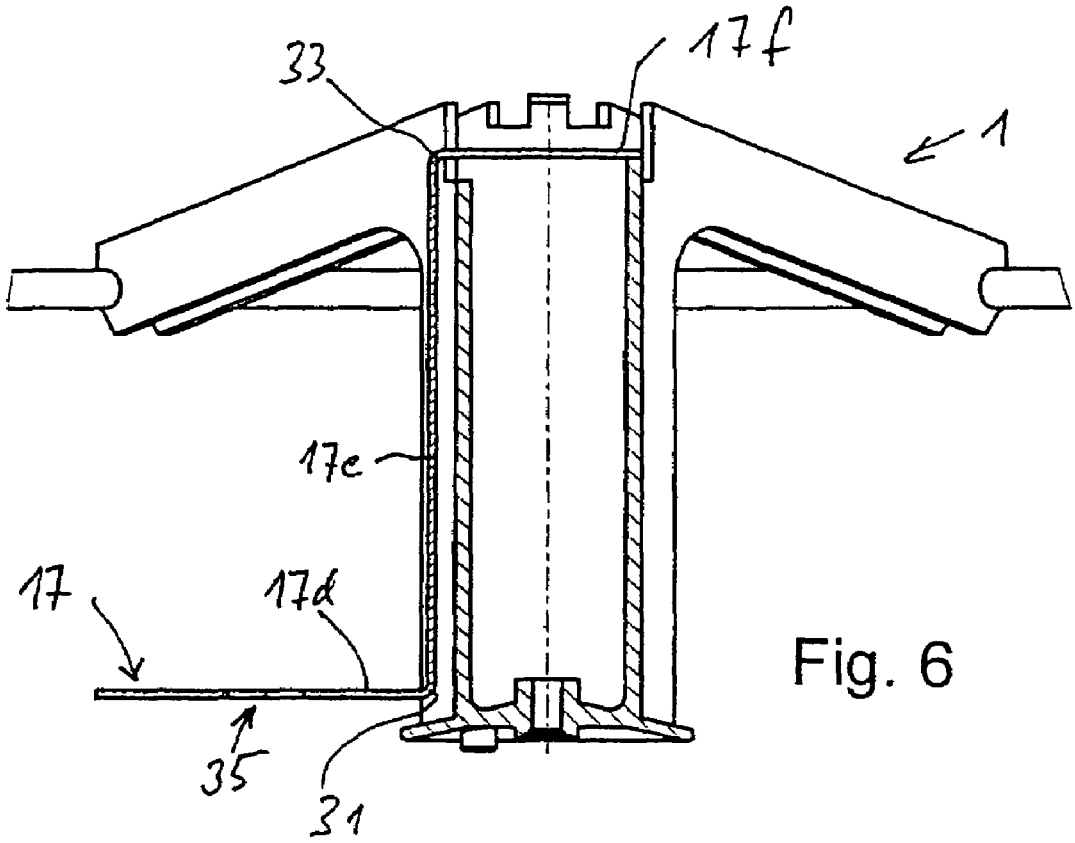
FIG. 6 shows an axial cross-sectional illustration through an antenna element device having a first embodiment of an associated coupling section according to the invention.

FIG. 6 shows the bending axis or edge line 31 at the bottom, and the further bending and/or edge line 33 at the top, on which the coupled stripline 17 is in each case bent through 90° in the illustrated exemplary embodiment, so that the feed line section 17*f* which has been bent around is once again parallel to the coupling section of the coupling surface 17*b* located at the bottom.

Merely for the sake of completeness, it should also be. mentioned that, at the transition from the connecting section 17*d* to the supporting section 17*e*, this supporting section 17*e* has a tapered section 17*e*' in a small detail length.

If the position and/or length of the feed stripline 13*a* changes in its longitudinal direction as a result of vibration, mechanical or other deformation or influences, or else as a result of thermal influences, the overall design means that this stripline 13*a* can, if necessary, carry out a relative movement in its longitudinal direction with respect to the coupling surface 17*b* of the coupled stripline 17 without this leading in a mechanical or electrical sense to any adverse effect or detectable adverse effect.

In particular, the assembly process can be carried out without any soldering just by placing the isolating receptacle or holder 21 on the stripline network at the relevant points and then inserting the coupled stripline 17 into it and fixing it with the bracket and holding device 27, whose supporting section 17*e* represents a component of the antenna element device 1.

Figure 7:
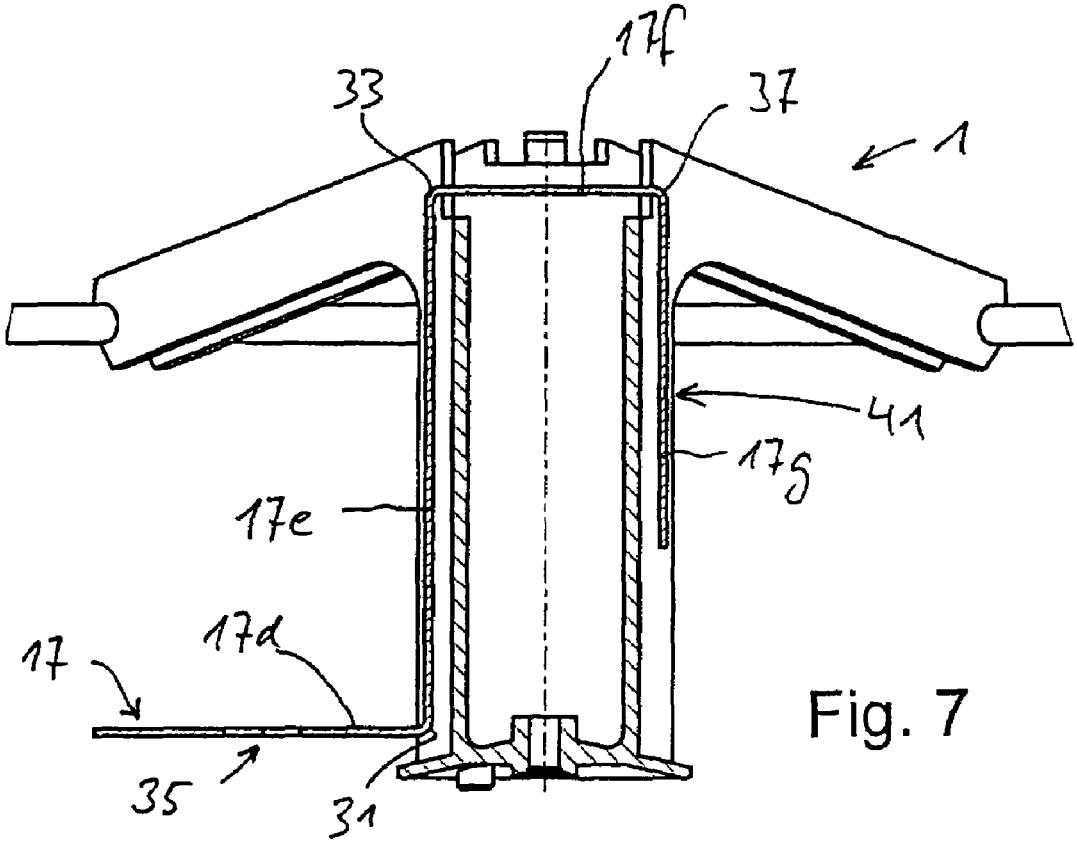
FIG. 7 shows a corresponding cross-sectional illustration with a modified embodiment of a coupling device.

The section illustration shown in FIGS. 6 and 7 is a section at right angles through the surface of the appliance or antenna element line section 17*e*, so that the section line between the coupling surface 17*b*, which runs in the longitudinal direction, and the connecting section 17*d*, which runs away at right angles from it, runs in the free corner area 35 formed in this way, for which reason only one side view of the coupled stripline 17 can be seen in this free corner area 35 in the view shown in FIGS. 4 and 5 while, in contrast, the stripline 17 is then shown in the form of a section adjacent to this, in FIGS. 4 and 5 (identified by the shading).

In the exemplary embodiment shown in FIG. 7, the coupled stripline 17 has once again been lengthened and, opposite its line section 17*f* at the top, has a line section 17*g* which has once again been bent through 90° about a further bending axis or edge line 37 which, in the illustrated exemplary embodiment, runs parallel to the line section 17*e* which is arranged on the opposite side of the antenna element device 1.

This results in capacitive coupling 41 to a corresponding line section of an associated dipole half of an antenna element device which acts as a cruciform dipole.

The invention claimed is:

1. An antenna feed network that capacitively couples a stripline to a coupled line, at least a portion of said antenna feed network extending parallel to a ground face, said antenna feed network comprising:

a stripline, a capacitive coupling device providing a capacitive connection to said coupled line, the stripline extending at the capacitive coupling device parallel to the ground face, at the capacitive coupling device, the stripline of the feed network having a first coupling section with a first coupling face and the coupled line having a second coupling section associated with a second coupling face, the first and second coupling faces being disposed in parallel to one another, a retaining clip that fixes the relative positions of the first coupling section and the second coupling section in such a way to permit relative parallel positional shifts between the first and second coupling sections, wherein the stripline's width is wider than the coupled line so that the stripline can change its parallel position relative to the coupled line without adversely affecting electrical coupling therebetween.

2. The feed network according to claim 1, wherein the coupled line has a planer coupling surface that is capacitively coupled to a planar coupling surface on the coupled stripline.

3. The feed network according to claim 1, wherein the coupled line comprises a support section following the coupling section for the production of an electrical connection with an antenna, the support section being connected by way of an angled union and/or curved axis means with the coupling section.

4. The feed network according to claim 3, wherein the retaining clip comprises dielectric material.

5. The feed network according to claim 1, wherein the retaining clip comprises plural spacers disposed between the coupled stripline and the coupled line, and the network further comprises a clamping device via which the coupled line and a corresponding section of the stripline of the feed network are held against one another in a coupling area, with the interposition of the at least one dielectric spacer, said spacer being prestressed to allow parallel movement.

6. The feed network according to claim 3, wherein the retaining clip has a base and/or at least one spacer, which is located between the coupling surfaces, which point toward one another, of the stripline and of the coupled line, and holds the stripline and the coupled line at a predetermined distance therebetween.

7. The feed network according to claim 3, wherein the clip comprises side webs on the longitudinal faces of the coupled line and, at least in places, project beyond the height of the coupled line.

8. The feed network according to claim 3, wherein the retaining clip comprises a transverse web.

9. The feed network according to claim 3, wherein the coupled line section has a connecting section adjacent to the coupling section, which connecting section preferably runs transversely with respect to the coupling section and is adjacent to the coupling section at an angle, of 90°.

10. The feed network according to claim 9, wherein the retaining clip is provided in the region of the connecting section with web sections which at least partially and/or in places surround the connecting section on its side areas.

11. The feed network according to claim 3, wherein the retaining clip is of such a size that, in the transverse direction with respect to the coupled line and with respect to the stripline, it projects both beyond the coupled line and beyond the stripline of the feed network in the coupling area.

12. The feed network according to claim 4, wherein the retaining clip has a thickness which is less than twice the thickness of the coupled line and/or is less than twice the thickness of the stripline in the coupling area.

13. The feed network according to claim 12, wherein the thickness of the retaining clip between the coupled line and the associated stripline in the coupling area is less than the thickness of the coupled line and/or the stripline to be precise by at least 10%.

14. The feed network according to claim 4, wherein the dielectric material between the coupled line and the stripline of the feed network in the coupling area is formed from a flexible printed circuit.

15. The feed network according to claim 4, wherein the dielectric material between the coupled line and the stripline of the feed network is formed from the group consisting of a plastic, plastic film, a varnish layer, and a solder resist on a synthetic resin base.

16. The feed network according to claim 1, wherein at least one bracket and/or holding devices is provided and is plugged on to the coupled line in the transverse direction in the area of the stripline, and is arranged such that the coupled line and the stripline, which runs parallel to it, together with the retaining clip located therebetween, are held, prestressed with respect to one another, in contact allowing parallel movement.

17. The feed network according to claim 1, wherein the feed network is arranged opposite the ground face comprising a conductive reflector, with air as a dielectric therebetween.

18. The feed network according to claim 1, wherein the feed network is disposed on a substrate, in the form of a printed circuit, opposite one of the other faces of the substrate, on which a conductive ground plane is formed.

19. The feed network according to claim 1, wherein the retaining clip has at least one supporting foot, which runs in the direction of the surface of the ground face, thus restricting the minimum separation between the retaining clip and the surface of the ground face.

20. The feed network according to claim 1, wherein the coupled line is provided with at least one bend, with each of the subsequent sections of the coupled stripline being an integral part of an antenna element.

21. The feed network according to claim 20, wherein the coupled line forms part of an antenna element and has a feed section which is conductively connected at its end to the antenna element.

22. The feed network according to claim 21, wherein the coupled line which forms part of the antenna element has a feed section which has a further capacitive coupling section, via which the coupled stripline is electrically capacitively coupled to the antenna element.

23. The feed network of claim 1 wherein the retaining clip is structured such that the permitted parallel positional change between the stripline and the coupled line introduces only a negligible phase shaft.

24. An antenna feed network for feeding an antenna radiator disposed above a ground plane, said feed network comprising:

a first flat stripline having a first coupling section spaced above said ground plane;

a second flat stripline forming an integral portion of said antenna radiator, said second flat stripline having a second coupling section also spaced above said ground plane, wherein one of the first and second stripline coupling sections is wider than the other to permit parallel positional shifts therebetween without substantially changing the coupling impedance therebetween; and a retaining clip that mechanically retains said first coupling section relative to said second coupling section to thereby provide a non-contacting capacitive coupling between said first and second striplines, said retaining clip being prestressed so as to establish and maintain a relative positional relationship between the first and second coupling sections that permits limited relative parallel positional shifts between the first and second coupling sections.

* * * * *